US008984690B2

(12) United States Patent
Chunglo

(10) Patent No.: US 8,984,690 B2
(45) Date of Patent: Mar. 24, 2015

(54) MATTRESS AND SIDE RAIL ASSEMBLY WITH HIGH AIRFLOW

(75) Inventor: Christopher F. Chunglo, Marietta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 80 days.

(21) Appl. No.: 13/295,845

(22) Filed: Nov. 14, 2011

(65) Prior Publication Data

US 2013/0025068 A1 Jan. 31, 2013

Related U.S. Application Data

(60) Provisional application No. 61/513,090, filed on Jul. 29, 2011, provisional application No. 61/513,091, filed on Jul. 29, 2011.

(51) Int. Cl.
*A47C 17/00* (2006.01)
*A47C 27/14* (2006.01)

(52) U.S. Cl.
CPC ..... *A47C 27/14* (2013.01)
USPC ..... 5/739; 5/638; 5/709; 5/724

(58) Field of Classification Search
CPC ..... A47C 7/18; A47C 27/00; A47C 21/00; A47C 27/06
USPC ..... 5/638, 739, 724, 606, 695, 704, 709, 5/714, 718
See application file for complete search history.

(56) References Cited

U.S. PATENT DOCUMENTS 3,748,288 A * 7/1973 Winkler et al. ..... 521/52
4,233,700 A 11/1980 Spann et al.
4,331,555 A * 5/1982 Baskent et al. ..... 516/13
4,379,757 A * 4/1983 Baskent et al. ..... 502/167
4,757,564 A * 7/1988 Goodale ..... 5/669
4,903,446 A * 2/1990 Richards et al. ..... 52/223.6
5,093,946 A * 3/1992 Difloe ..... 5/652.1
5,388,296 A 2/1995 Mansour
5,643,139 A * 7/1997 Stout et al. ..... 482/14
5,690,855 A * 11/1997 Nichols et al. ..... 252/182.27
5,701,623 A * 12/1997 May ..... 5/739
5,708,045 A * 1/1998 Thompson et al. ..... 521/174
5,850,648 A * 12/1998 Morson ..... 5/724
6,093,752 A * 7/2000 Park et al. ..... 521/139
6,564,411 B2 * 5/2003 Pirzada ..... 5/713
6,601,253 B1 8/2003 Tarquinio et al.
6,935,697 B2 * 8/2005 Conlon et al. ..... 297/423.41
7,059,001 B2 * 6/2006 Woolfson ..... 5/740
7,238,730 B2 * 7/2007 Apichatachutapan et al. ..... 521/174
7,520,012 B2 * 4/2009 Robins ..... 5/740
7,690,096 B1 * 4/2010 Gladney et al. ..... 29/428
8,001,638 B1 * 8/2011 Quinter et al. ..... 5/722
8,832,888 B2 9/2014 Chunglo
2002/0148047 A1 * 10/2002 Corzani et al. ..... 5/738

(Continued)

*Primary Examiner* — Robert G Santos
*Assistant Examiner* — Myles Throop
(74) *Attorney, Agent, or Firm* — Cantor Colburn LLP

(57) ABSTRACT

A side rail assembly for supporting an edge of a mattress includes a layer of a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, wherein the layer is configured to be disposed about a perimeter of an inner core of the mattress and is configured to permit the flow of fluid from and to the inner core through the layer.

19 Claims, 1 Drawing Sheet

(56) References Cited

U.S. PATENT DOCUMENTS

| | | | | |
|---|---|---|---|---|
| 2005/0085613 | A1* | 4/2005 | Adkins et al. | 528/44 |
| 2005/0222286 | A1* | 10/2005 | Gilder et al. | 521/128 |
| 2007/0056116 | A1* | 3/2007 | Galardo | 5/724 |
| 2008/0083069 | A1* | 4/2008 | Dell'Accio | 5/740 |
| 2009/0113636 | A1* | 5/2009 | Dell'Accio | 5/740 |
| 2010/0170042 | A1* | 7/2010 | Rose | 5/698 |
| 2010/0319137 | A1 | 12/2010 | Witherell et al. | |
| 2012/0028024 | A1* | 2/2012 | Obi et al. | 428/304.4 |
| 2012/0167312 | A1* | 7/2012 | Sobran et al. | 5/739 |
| 2013/0025065 | A1 | 1/2013 | Chunglo | |

* cited by examiner

MATTRESS AND SIDE RAIL ASSEMBLY WITH HIGH AIRFLOW

CROSS-REFERENCE TO RELATED APPLICATIONS

This application claims the benefit of U.S. Provisional Application Ser. No. 61/513,090 filed Jul. 29, 2011 and U.S. Provisional Application Ser. No. 61/513,091 filed Jul. 29, 2011, which are incorporated herein by reference in their entirety.

BACKGROUND

The present disclosure generally relates to foam mattress assemblies; specifically side rail assemblies of the mattress that exhibit increased airflow.

Foam mattresses such as those formed of polyurethane foam, latex foam, and the like, are generally known in the art. One of the ongoing problems associated with foam mattress assemblies is user comfort. To address user comfort, these mattresses are often fabricated with multiple foam layers having varying properties such as density and hardness, among others, to suit the needs of the intended user. More recently, manufacturers have employed so called memory foam, also commonly referred to as viscoelastic foams, which are generally a combination of polyurethane and one or more additives that increase foam density and viscosity, thereby increasing its viscoelasticity. These foams are often open cell foam structures having both closed and open cells but in some instances may be reticulated foam structures. The term "reticulated" generally refers to a cellular foam structure in which the substantially all of the membrane windows are removed leaving a skeletal structure. In contrast, open cell structures include both open cell (interconnected cells) and closed cells.

When used in a mattress, the memory foam conforms to the shape of a user when the user exerts pressure onto the foam, thereby minimizing pressure points from the user's body. The memory foam then returns to its original shape when the user and associated pressure are removed. However, the return to the original shape is a relatively slow process because of the viscoelastic cellular structure of these types of foams.

Unfortunately, the high density of foams used in current mattress assemblies, particularly those employing memory foam layers, generally prevents proper ventilation. As a result, the foam material can exhibit an uncomfortable level of heat to the user after a period of time. Additionally, these foams can retain a high level of moisture, further causing discomfort to the user and potentially leading to foul odors.

Reticulated memory foams, i.e., foams in which the cellular walls are substantially removed, are known to provide greater airflow. However, because substantially all of the cellular walls have been removed leaving behind a skeletal structure, these foams are inherently weak, provide less load-bearing capabilities relative to other non-reticulated viscoelastic foams, and are subject to fatigue at a rate faster than partially or completely closed cell foam structures. Moreover, reticulated viscoelastic foams require special processing to remove the cellular walls to form the skeletal structure making these foams relatively expensive.

Moreover, much like the foam mattresses described above, the current side rail assemblies, used in the mattress assemblies for edge support, also tend to act as an air dam blocking the flow of air out of the mattress. This can further reduce the ventilation of the mattress assembly and increase the amount of heat and/or moisture retained in the mattress. These side rail assemblies can redirect the flow of air (and heat and moisture) back through the top sleeping surface, thereby adding to the discomfort experienced by the user.

Accordingly, it would be desirable to provide a mattress assembly, especially a side rail assembly including one or more layers of viscoelastic memory foam, with an improved airflow to aid in the dissipation of user heat.

BRIEF SUMMARY

Disclosed herein are rail systems and mattress assemblies exhibiting increased airflow. In one embodiment, a side rail assembly for supporting an edge of a mattress includes a layer of a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, wherein the layer is configured to be disposed about a perimeter of an inner core of the mattress and is configured to permit the flow of fluid from and to the inner core through the layer.

In another embodiment, a mattress assembly comprises an inner core comprising a viscoelastic foam layer comprising planar top and bottom surfaces, a density of about 3 pounds per cubic foot and a hardness less than about 15 pounds-force; and a side rail assembly disposed adjacent to and in physical communication with the inner core, wherein the side assembly comprises a layer of a polyurethane foam comprising an open cellular structure having planar top and bottom surfaces, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, and wherein the layer of the open cell polyurethane foam is in fluid alignment with the viscoelastic foam layer and is configured to permit the flow of fluid from and to the inner core through the side rail assembly.

In still another embodiment, a mattress assembly comprises an inner core comprising a base core layer comprising planar top and bottom surfaces, a transition support layer comprising planar top and bottom surfaces disposed on the top surface of the base core layer, and a cover layer comprising planar top and bottom surfaces disposed on the transition support layer, wherein the transition support layer comprises a viscoelastic foam having a density of about 3 pounds per cubic foot and a hardness less than about 15 pounds-force; and a side rail assembly disposed about a perimeter of the inner core, wherein the side rail assembly comprises a base rail layer comprising planar top and bottom surfaces disposed adjacent to the base core layer, a middle rail layer comprising planar top and bottom surfaces disposed on the top surface of the base rail layer, and a top rail layer comprising planar top and bottom surfaces disposed on a top surface of the middle rail layer, wherein the middle rail layer comprises a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, and wherein the middle rail layer is in fluid alignment with the transition support layer and is configured to permit the flow of fluid from and to the inner core through the side rail assembly.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Disclosed herein are side rail assemblies (and mattress assemblies including the side rails), which provide user comfort with improved airflow to effectively dissipate user heat during use. The side rail assemblies advantageously include a high air flow foam that permits the flow of air and moisture from an inner core of the mattress assembly through the high air flow foam of the side rail assembly and out to the surrounding environment. Such removal of warm air and moisture can improve the sleeping experience of the mattress user.

The side rail assemblies can be disposed about a perimeter of the mattress inner core and provide support to the edge of a mattress. At least a portion of the side rail assembly, in some embodiments the entire assembly, in other embodiments one or more layers, is comprises of the high airflow foam, which is described in detail below.

Figure 1:
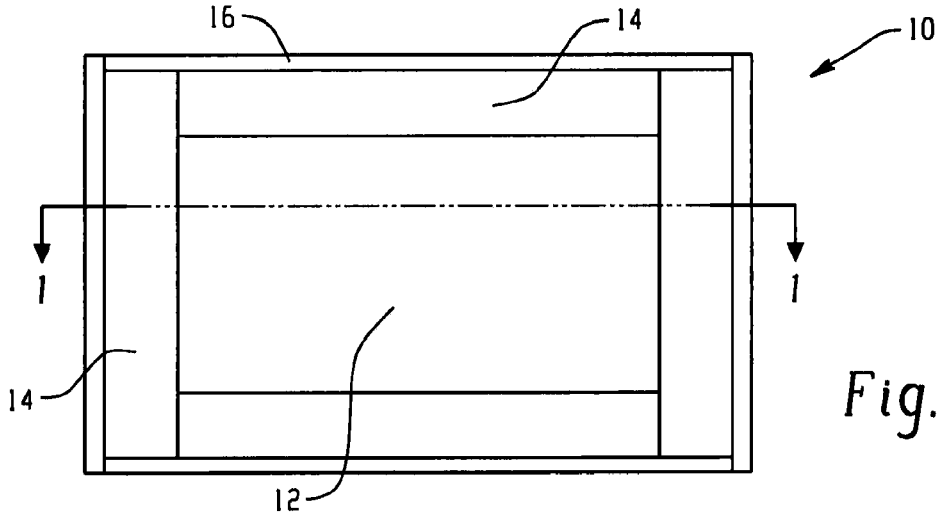
FIG. 1 illustrates a top down view of a mattress assembly.

Turning now to FIG. 1, a top down view representative of the various mattress assemblies is illustrated, which are generally designated by reference numeral 10. As will be discussed herein, the various embodiments of the mattress assemblies disclosed herein have in common the following components: multiple stacked layers, wherein the uppermost foam layer 12 is shown, a side rail assembly 14 about at least a portion of the perimeter of the stacked mattress layers, and an optional fabric covering 16 about the side rail assembly as shown, i.e., mattress border. The uppermost layer is generally referred to herein as the cover layer and has a planar top surface adapted to substantially face the user resting on the mattress assembly and having a length and width dimensions sufficient to support a reclining body of the user.

Figure 2:
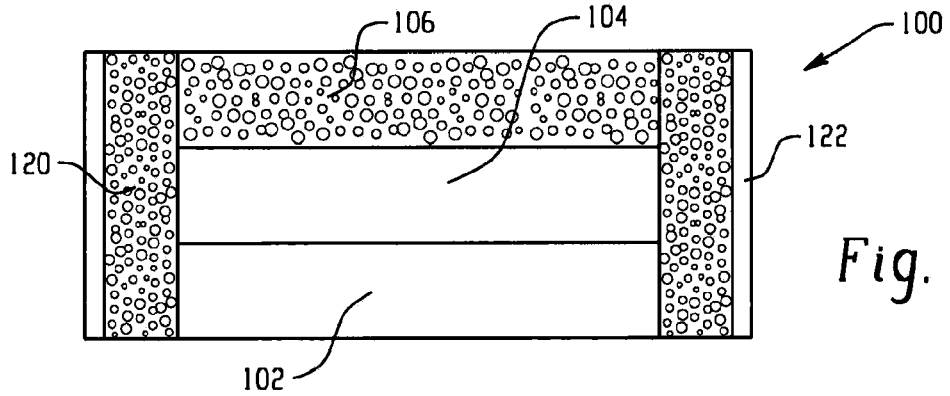
FIG. 2 illustrates a cross sectional view of a mattress assembly taken along line 1-1 of FIG. 1 in accordance with an embodiment of the present disclosure.

FIG. 2 shows a cross sectional view of a mattress assembly in accordance with one embodiment. The mattress assembly 100 includes a base core foam layer 102 configured with generally planar top and bottom surfaces. For this as well as the other embodiments disclosed herein, the base core foam layer 102 is chosen to have a thickness greater than or equal to the overall thickness of the mattress assembly. Generally, the thickness of the base core foam layer 102 is 4 inches to 10 inches, with about 6 inches to 8 inches thickness in other embodiments, and about 6.5 inches in still other embodiments. The base core foam layer can be formed of standard polyurethane foam although other foams can be used, including without limitation, viscoelastic foams. In one embodiment, the base core foam layer is an open cell polyurethane foam. In other embodiments, the base core foam layer is a closed cell polyurethane foam. The base core foam layer 102 has a density of 1 pound per cubic foot (lb/ft$^3$) to 5 lb/ft$^3$. In other embodiments, the density is 1 lb/ft$^3$ to 3 lb/ft$^3$ and in still other embodiments, from 1 lb/ft$^3$ to 2 lb/ft$^3$. By way of example, the density can be 1.65 lb/ft$^3$. The hardness of the base core foam layer, also referred to as the indention load deflection (ILD) or indention force deflection (IFD), is within a range of 20 to 40 pounds-force, wherein the hardness is measured in accordance with ASTM D-3574 and is generally defined as the amount of force in pounds required to indent a 50" disc into a 15" x 15" x 4" foam sample and make a 1" indentation. In one embodiment, the hardness is about 32 to 35 pounds-force.

A relatively thin pre-stressed polyurethane foam layer 104 including planar top and bottom surfaces is disposed on the base core foam layer 102. Suitable pre-stressed polyurethane foams are generally formed in the manner disclosed in US Pat. No. 7,690,096to Gladney et al., incorporated herein by reference in its entirety. By way of example, a force can be applied to at least a section of a standard polyurethane foam layer in an amount sufficient to temporarily compress its height so as to permanently alter a mechanical property of the foam layer to provide a pre-stressed foam layer having a firmness that is different from the firmness of a similar polyurethane foam that was not pre-stressed. The pre-stressed polyurethane foam layer is a standard polyurethane foam as noted above (i.e., not viscoelastic) and generally has a pre-stressed thickness of less than 1 inch. The density is generally less than 2.5 lb/ft$^3$ in some embodiments, and less than 2 lb/ft$^3$ in still other embodiments. The hardness is generally less than 30pounds-force in some embodiments, and less than pounds-force in still other embodiments. In one embodiment, the thickness is 0.5 inches, the hardness is 22 pounds-force, and the density is 1.5 lb/ft$^3$.

A cover panel 106 is formed of a viscoelastic foam and disposed on the polyurethane foam layer 104. The viscoelastic polyurethane foam has an open cell structure, wherein the percentage of intact windows (i.e., cell walls) between adjacent cells is less than 50percent in one embodiment, and less than 40 percent in other embodiments, and less than 30 percent in still other embodiments. The cover panel 106 has planar top and bottom surfaces. The thickness of the cover panel is generally less than 3" in some embodiments, and less than 2" in other embodiments. The density of the cover panel layer 106 is less than 3 lb/ft$^3$ in some embodiments, and less than 2.5 lb/ft$^3$ in other embodiments. In one embodiment, the hardness is generally less than 15 pounds-force. In one embodiment, the cover panel is at a thickness of 1.5", a density of 2.5 lb/ft$^3$, and a hardness is 12 pounds-force.

The various multiple stacked mattress layers 102, 104, and 106 may be adjoined to one another using an adhesive or may be thermally bonded to one another or may be mechanically fastened to one another.

The mattress assembly further includes a foam side rail assembly 120 about all or a portion of the perimeter of the mattress layers 102, 104, 106. The side rails that define the assembly may be attached or placed adjacent to at least a portion of the perimeter of the mattress layers 102, 104, 106, and the foam may further include springs, latex, gel, viscoelastic gel, or a combination, in one or more layers. Side rails may be placed on opposing sides of the stacked mattress layers, on all four sides of the stacked mattress layers, or only on one side of the stacked mattress layers. In certain embodiments, the side rails may comprise edge supports with a firmness greater than that provided by the stacked mattress layers. The side rails may be fastened to the stacked mattress layers via adhesives, thermal bonding, or mechanical fasteners.

The side rail assembly 120 is formed of open cell polyurethane foam having a non-random large cell structure or a random cellular structure with many large cells. The open cell foam structure includes a plurality of interconnected cells, wherein the windows between the adjacent cells are broken and/or removed. In contrast, a closed cell foam has substantially no interconnected cells and the windows between the adjacent cells are substantially intact. In reticulated foams, substantially all of the windows are removed. The polyurethane foam of the side rail assembly 120 has an open cell structure, wherein the percentage of intact windows (i.e., cell walls) between adjacent cells is less than about 50 percent; specifically less than about 40 percent; more specifically less than about 30 percent; and still more specifically less than about 20percent. The large cell structure can also be defined by the number of cells per linear inch. In one embodiment, the large cell structure is about 10 to 40 cells per inch, with about 15 to 30 cells per inch in other embodiments, and with about 20 cells per inch in still other embodiments. The hardness of the foam side rail, also referred to as the indention load deflection (ILD) or indention force deflection (IFD), is within a range of about 35 to about 100 pounds-force, wherein the hardness is measured in accordance with ASTM D-3574. In one embodiment, the hardness is about 45 to about 90 pounds-force; and specifically about 50 to about 75 pounds-force. The high air flow foam of the side rail assembly further includes a density of about 1.0 to about 3.0 pounds per cubic foot; and specifically about 1.2 to about 2.0 pounds per cubic foot.

By using an open cell structure with a large cellular or a random cell structure, a high airflow foam is created wherein movement of moisture and air through one or more of the side rails in the assembly 120 can occur. Also, if the side rail is adhesively or thermally attached to the mattress layers, e.g., 102, 104, and 106, the skeletal struts of the open cell foam will bond to the mattress layers and the voids of the cell structure can remain free of adhesive agent. Air and moisture transfer is thereby facilitated from the mattress layers through the high air flow foam of the side rails to the environment. In one embodiment, the side rail assembly 120 includes a reticulated viscoelastic polyurethane foam.

For ease in manufacturing the mattress assembly, the side rail assembly may be assembled in linear sections that are joined to one another to form the perimeter about the mattress layers. The ends may be square as shown in the top down view FIG. 1 or may be mitered. Each section of the side rail assembly 120 includes a single layer of high air flow foam, as illustrated in the embodiment of FIG. 1. In other embodiments, the side rail assembly can have one or more layers. In still other embodiments, the side rail assembly can have the same number of layers as the mattress or the assembly can have a different amount of layers. In one embodiment, each layer of the side rail assembly is aligned with a corresponding layer of the mattress. Exemplary embodiments of multilayered side rail assemblies will be described in more detail below.

An optional fabric layer 122 is disposed about the perimeter of the side rail, i.e., serves as a mattress border. The fabric border layer is attached at one end to the top planar surface of the uppermost mattress layer 106 and at the other end to the bottom planar surface of the bottom most layer 102. In one embodiment, at least a portion of the fabric layer is formed of a spacer fabric to provide a further increase in airflow. As used herein, spacer fabrics are generally defined as pile fabrics that have not been cut including at least two layers of fabric knitted independently that are interconnected by a separate spacer yarn. The spacer fabrics generally provide increased breathability relative to other fabrics, crush resistance, and a three dimensional appearance. The at least two fabric layers may be the same or different, i.e., the same or different density, mesh, materials, and like depending on the intended application. When employing the spacer fabric, a lightweight flame retardant barrier layer may be disposed intermediate to the mattress foam layers and the spacer fabric about the perimeter of the side rail assembly.

In the embodiment shown, the mattress assembly 100 is generally less than 12 inches in height. By way of example, an exemplary mattress assembly illustrative of the embodiment shown in FIG. 2 has a 6.5" foam core layer of standard polyurethane foam having a density of 1.65 lb/ft$^3$ and a hardness of about 32-35 pounds-force ILD; a 0.5" pre-stressed polyurethane foam intermediate layer; and 1.5" top cover layer of viscoelastic polyurethane foam having a density of 2.5 lb/ft$^3$ and a hardness of about 12 pounds-force. The side rail assembly may have a thickness of 2" and is formed of an open cell foam having about 20 cells per linear inch as described above. A mattress border and panel of a spacer fabric is utilized as a mattress border.

Figure 3:
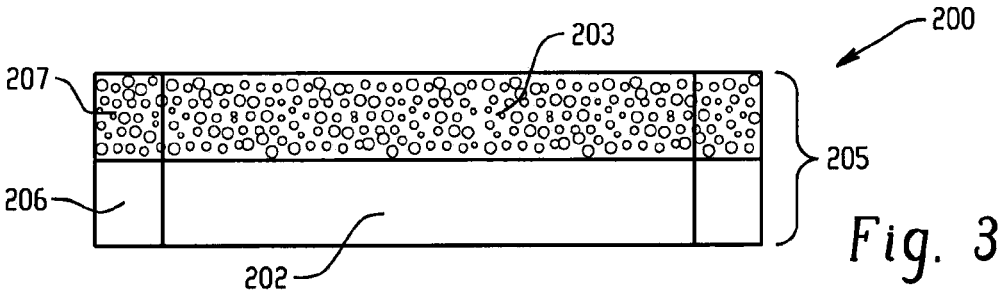
FIG. 3 illustrates a cross sectional view of a mattress assembly in accordance with an embodiment of the present disclosure.

FIG. 3 shows a cross sectional view of a mattress assembly in accordance with one embodiment. The mattress assembly 200 includes base core layer 202 configured with planar top and bottom surfaces. The base core layer 202 can be a standard spring support unit, or, alternatively, the layer can be formed of polyurethane foam, although other foams can be used, including without limitation, viscoelastic foams. In one embodiment, the base core foam layer is an open cell polyurethane foam. In other embodiments, the base core foam layer is closed cell polyurethane foam.

A support layer 203 having planar top and bottom surfaces and formed of standard polyurethane foam is disposed on the base core layer 202. The support layer 203 is formed of a high airflow foam. In one embodiment, the support layer 203 is formed of a viscoelastic polyurethane foam. Like the cover panel 106 of the mattress assembly 100 described above, the viscoelastic polyurethane foam of the support layer 203 has an open cell structure, wherein the percentage of intact windows between adjacent cells is less than 50 percent in one embodiment, and less than 40 percent in other embodiments, and less than 30 percent in still other embodiments. The cover panel 106 has planar top and bottom surfaces. The density of the support layer can be less than about 3 lb/ft$^3$; specifically less than about 2.5 lb/ft$^3$. In one embodiment, the hardness is generally less than about 15 pounds-force.

The mattress assembly 200 further includes a side rail assembly 205. In this embodiment, the side rail assembly 205 includes a base rail layer 206 disposed in physical communication with and adjacent to the base core foam layer 202. A top rail layer 207 is disposed above the base rail layer 206. The top rail layer 207 is formed of a high airflow open-cell foam having a non-random large cell structure or a random cellular structure with many large cells. As described above, the high airflow foam of the top rail layer 207 has an open cell structure, wherein the percentage of intact windows (i.e., cell walls) between adjacent cells is less than about 50 percent; specifically less than about 40 percent; more specifically less than about 30 percent; and still more specifically less than about 20 percent. In one embodiment, the large cell structure is about 10 to 40 cells per inch, with about 15 to 30 cells per inch in other embodiments, and with about 20 cells per inch in still other embodiments.

The top rail layer 207 is aligned with the support layer 203 of the mattress. Because both layers are formed of high airflow foams, the top rail layer 207 of the side rail assembly 205 acts as a vent through the side rail assembly to permit the flow of air and moisture from the mattress' base core and support layers through the top rail layer and out of the mattress.

The side rails of the assembly 205 may be fastened to the stacked mattress layers via adhesives, thermal bonding, or mechanical fasteners. Again, if the rails are adhesively or thermally attached to the mattress layers, e.g., 202 and 203, the skeletal struts of the open cell foam in the top rail layer 207 will bond to at least one of the mattress layers (e.g., the support layer 203) and the voids of the cell structure can remain free of adhesive agent. As such, air and moisture transfer is uninterrupted by the thermal bonding process or adhesive and airflow from the mattress layers through the side rails to the environment is maintained.

Figure 4:
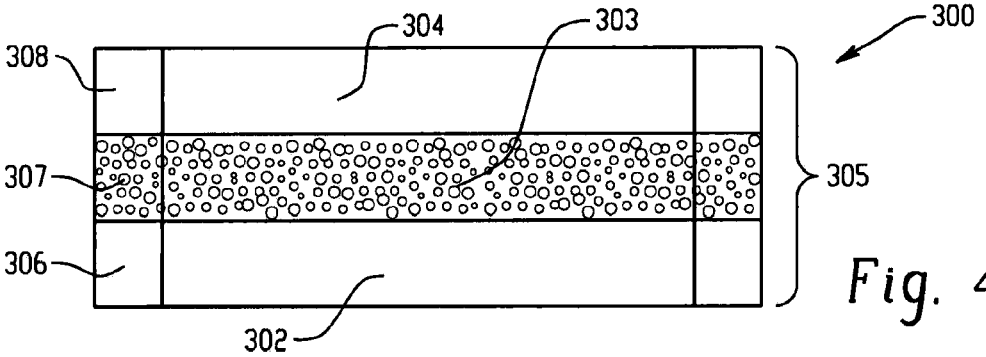
FIG. 4 illustrates a cross sectional view of a mattress assembly in accordance with an embodiment of the present disclosure.

FIG. 4. shows a cross sectional view of a mattress assembly in accordance with one embodiment. The mattress assembly 300 is similar to that of mattress assembly 200 described above, except the mattress includes three distinct layers, rather than two. Specifically, the mattress includes a base core layer 302, which can formed of standard polyurethane foam; a transition support layer 303 formed of a high airflow foam disposed on the base core layer 302; and a cover layer 304 having planar top and bottom surfaces disposed on the transition support layer 303.

The mattress assembly 300 further includes a side rail assembly 305 disposed about the perimeter of the mattress. In this embodiment, the side rail assembly 305 includes three distinct layers, wherein each layer is aligned with a particular layer of the mattress. A base rail layer 306 is disposed in physical communication with and adjacent to the base core layer 302. A middle rail layer 307 is disposed above the base rail layer 306. The middle rail layer 307 is formed of a high airflow open-cell foam having a non-random large cell structure or a random cellular structure with many large cells, as described in the other embodiments above. The middle rail layer 307 is adjacent to and in physical communication with the high airflow foam transition support layer 303. Finally, a top rail layer 308 is disposed on a side of the middle rail layer 307 opposite the base rail layer 306. The top rail layer 308 can be formed of any suitable mattress material, such as a standard polyurethane foam, or it may include a high air flow foam like that of middle rail layer 307.

The middle rail layer 307 is advantageously aligned with the high air flow transition support layer 303 of the mattress. Because both layers are formed of high airflow foams, the middle rail layer 307 of the side rail assembly 305 acts as a vent through the side rail assembly to permit the flow of air and moisture from the base core and support layers through the top rail layer and out of the mattress.

The mattress assemblies described herein may further include additional layers and the embodiments described herein are not intended to be limited with respect to number, type, or arrangement of layers in the mattress and side rail assembly. For example, an embodiment of a mattress assembly can further include a gel infused viscoelastic foam layer disposed within the mattress, such as on the support layer. In another embodiment, the mattress assembly further includes a cover panel formed of a viscoelastic foam disposed, for example, on the top layer of the mattress having a planar top surface and a convoluted bottom surface. The convoluted bottom surface, such as an egg crate structure, is in contact with the top planar surface of the mattress, which may be in one embodiment, the gel infused viscoelastic layer.

The various mattress layers in the mattress assemblies and the side rail assemblies described above may be adjoined to one another using an adhesive or may be thermally bonded to one another or may be mechanically fastened to one another.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A side rail assembly for supporting an edge of a mattress, comprising:

a multilayered structure comprising layer of a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, wherein a percentage of intact windows between adjacent cells in the open structure is less than about 50%, wherein the layer is configured to be disposed about a perimeter of an inner core free of open channels, of the mattress and is configured to permit the flow of fluid from and to the inner core through the layer, and wherein the multilayered structure is configured to contact only sidewalls of the inner core.

2. The side rail assembly of claim 1, further comprising an adhesive disposed between the layer and the inner core.

3. The side rail assembly of claim 1, wherein the inner core comprises a layer of foam comprising an open cellular structure and the polyurethane foam layer is aligned with this layer of the inner core.

4. The side rail assembly of claim 1, further comprising one or more additional layers disposed above, below, or a combination of above and below the foam layer, wherein the one or more additional layers are also disposed about a perimeter of the inner core.

5. The slide rail assembly of claim 4, wherein the one or more additional layers comprise non-viscoelastic foam, viscoelastic foam, pre-stressed foam, gel-infused foam, spring coils, encased spring coils, latex, or a combination thereof.

6. The side rail assembly of claim 1, wherein the open cellular structure of the polyurethane foam layer in the side rail assembly comprises a percentage of intact windows between adjacent cells that is less than about 50 percent.

7. A mattress assembly, comprising:

an inner core free of open channels comprising a viscoelastic foam layer the viscoelastic foam layer having an open cellular structure comprising planar top and bottom surfaces, a density less than about 3 pounds per cubic foot and a hardness less than about 15 pounds-force; and a multilayer side rail assembly configured to contract only sidewall of the inner core, wherein the side assembly comprises a layer of a polyurethane foam comprising an open cellular structure having planar top and bottom surfaces, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, and wherein a percentage of intact windows between adjacent cells in the open cellular structure is less then about 50%, wherein the layer of the open cell polyurethane foam is in fluid alignment with the viscoelastic foam layer and is configured to permit the flow of fluid from and to the inner core through the side rail assembly.

8. The mattress assembly of claim 7, further comprising an adhesive disposed between the inner core and the side rail assembly.

9. The mattress assembly of claim 7, wherein the inner core further comprises a non-viscoelastic foam layer comprising planar top and bottom surfaces and having a density equal to or less than about 1.65 pounds per cubic foot and a hardness equal to or less than about 35 pounds-force underlying the bottom planar surface of the viscoelastic foam layer.

10. The mattress assembly of claim 9, wherein the side rail assembly further comprises a second layer disposed on the bottom planar surface of the open cell polyurethane foam layer, wherein the second layer comprises non-viscoelastic foam, viscoelastic foam, pre-stressed foam, gel-infused foam, spring coils, encased spring coils, latex, or a combination thereof, and wherein the second layer has a width equal to a width of the side rail assembly polyurethane foam layer and is configured to contact only sidewalls of the inner core.

11. The mattress assembly of claim 7, wherein the side rail assembly is disposed about a perimeter of the inner core.

12. The mattress assembly of claim 9, wherein the inner core further comprises a pre-stressed foam layer comprising planar top and bottom surfaces disposed between the non-viscoelastic foam layer and the viscoelastic foam layer.

13. The mattress assembly of claim 10, wherein the side rail assembly further comprises a pre-stressed foam layer comprising planar top and bottom surfaces disposed between a second layer and the open cell polyurethane foam layer.

14. The mattress assembly of claim 7, wherein the open cellular structure of the layer of polyurethane foam comprises a percentage of intact windows between adjacent cells that is less than about 50 percent.

15. The mattress assembly of claim 7, further comprising a fabric layer disposed about the perimeter of the side rail assembly.

16. A mattress assembly, comprising:

an inner core free of open channels, comprising a base core layer comprising planar top and bottom surfaces, a transition support layer comprising planar top and bottom surfaces disposed on the top surface of the base core layer, and a cover layer comprising planar top and bottom surfaces disposed on the transition support layer, wherein the transition support layer comprises a viscoelastic foam having a density of about 3 pounds per cubic foot and a hardness less than about 15 pounds-force; and configured to contact only sidewalls of the inner core, disposed about a perimeter of the inner core, wherein the multilayered side rail assembly comprises a base rail layer comprising planar top and bottom surfaces disposed adjacent to the base core layer, a middle rail layer comprising planar top and bottom surfaces disposed on the top surface of the base rail layer, and a top rail layer comprising planar top and bottom surfaces disposed on a top surface of the middle rail layer, wherein the middle rail layer comprises a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, and wherein a percentage of intact windows between adjacent cells in the open cellular structure is less than about 50%, and wherein the base rail layer, the middle rail layer, and the top rail layer have equal widths, and wherein the middle rail layer is in fluid alignment with the transition support layer and is configured to permit the flow of fluid from and to the inner core through the side rail assembly.

17. The mattress assembly of claim 16, wherein the open cellular structure of the layer of polyurethane foam comprises a percentage of intact windows between adjacent cells that is less than about 50 percent.

18. The mattress assembly of claim 16, wherein a selected one or both of the base rail layer and the top rail layer comprises non-viscoelastic foam, viscoelastic foam, pre-stressed foam, gel-infused foam, spring coils, encased spring coils, latex, or a combination thereof.

19. The mattress assembly of claim 16, wherein the base core layer comprises a non-viscoelastic foam layer comprising planar top and bottom surfaces and having a density equal to or less than about 1.65 pounds per cubic foot and a hardness equal to or less than about 35 pounds-force disposed on the bottom planar surface of the viscoelastic foam layer.

* * * * *